US005511790A

United States Patent [19]

Duran

[11] Patent Number: 5,511,790

[45] Date of Patent: Apr. 30, 1996

[54] PUTTER GRIP ATTACHMENT

[76] Inventor: Anthony P. Duran, 135 Main St., Depew, N.Y. 14043

[21] Appl. No.: 443,099

[22] Filed: May 17, 1995

Related U.S. Application Data

[63] Continuation of Ser. No. 132,563, Oct. 6, 1993, abandoned.

[51] Int. Cl.[6] ..... A63B 53/14

[52] U.S. Cl. ..... 473/201; 473/298; 473/300

[58] Field of Search ..... 273/75, 81 R, 273/81.6, 72 R, 72 A, 187.5, 165, 81.5, 81 B, 81 D, 67 R, 75; 294/86 CG

[56] References Cited

U.S. PATENT DOCUMENTS

| | | | |
|---|---|---|---|
| 1,617,972 | 2/1927 | Wallace | 273/75 |
| 2,672,342 | 3/1954 | Griffin | 273/75 |
| 3,147,012 | 9/1964 | Sullivan | 273/75 |
| 3,638,987 | 2/1972 | Fidrych | 294/86 CG |

FOREIGN PATENT DOCUMENTS

| | | | |
|---|---|---|---|
| 27613 | of 1911 | United Kingdom | 273/81 R |

*Primary Examiner*—Mark S. Graham
*Attorney, Agent, or Firm*—Joseph P. Gastel

[57] ABSTRACT

A putter grip sensitizing attachment for installation over the existing putter grip having first and second ends for sensitizing the feel of the putter to the hands of a golfer including an elongated tubular expandible plastic mesh having first and second ends, a first adhesive plastic tape for securing the first end of the plastic mesh proximate the first end of the putter grip and a second adhesive plastic tape for securing the second end of the plastic mesh proximate the second end of the putter grip.

8 Claims, 1 Drawing Sheet

Fig. 2.
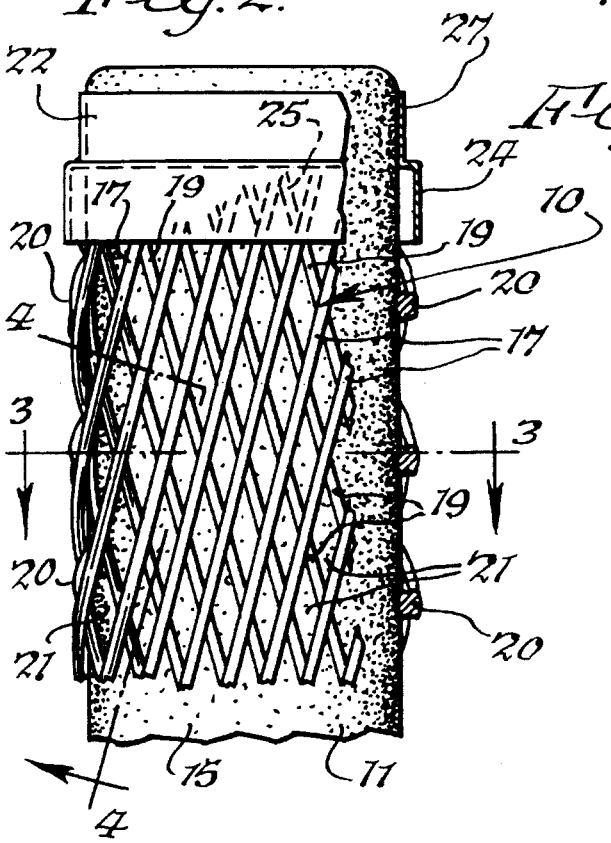
Fig. 5.
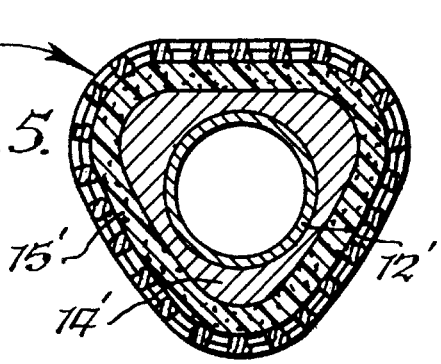
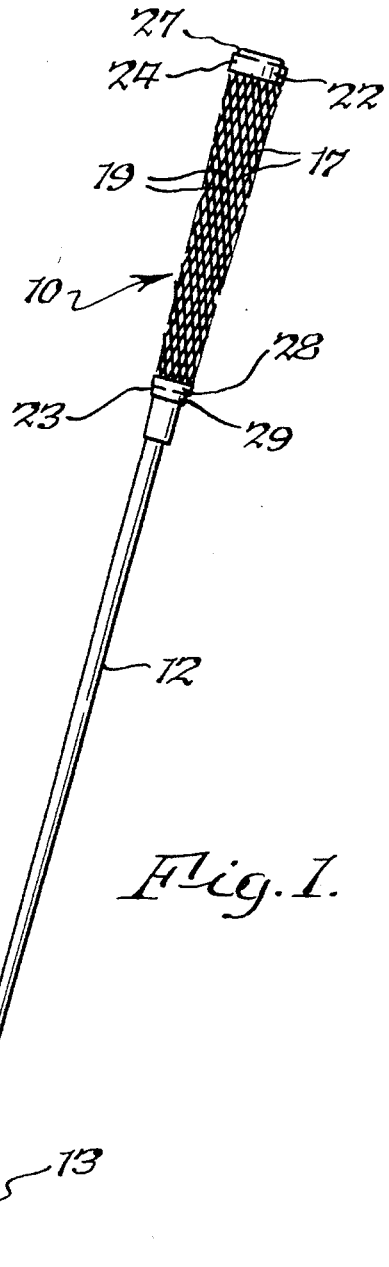
Fig. 1.
Fig. 3.
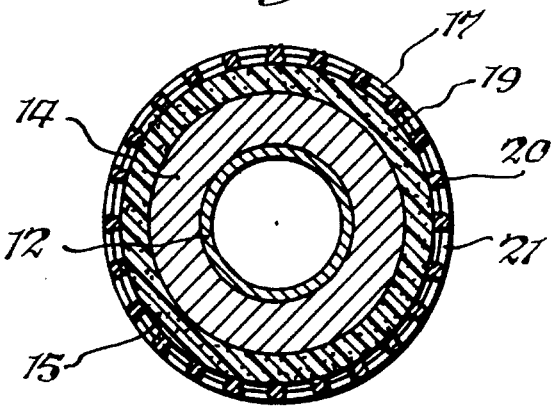
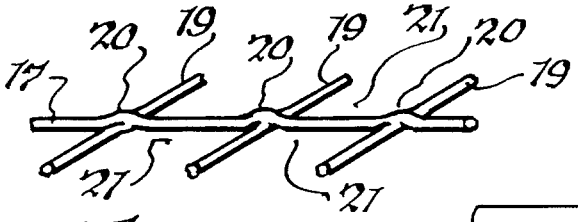
Fig. 4.

PUTTER GRIP ATTACHMENT

This application is a Continuation, of application Ser. No. 08/132,563, filed Oct. 6, 1993, abandoned.

BACKGROUND OF THE INVENTION

The present invention relates to a putter grip sensitizer attachment for sensitizing the golfer's hands to provide better control.

By way of background, in putting, golfers many times either grip the club too tightly or too lightly, which in turn reduces the amount of control they have during putting. This in turn causes the golf ball to be struck too hard or too soft or not in a direct line with the cup.

SUMMARY OF THE INVENTION

It is accordingly the primary object of the present invention to provide a putter grip sensitizer attachment which will sensitize the golfer's hands to cause him to grip the putter with a secure and sensitive grip which enhances his control over the force and direction of the putting stroke. Other objects and attendant advantages of the present invention will readily be perceived hereafter.

The present invention relates to a putter grip sensitizer attachment for installation over an existing putter grip for sensitizing the feel of the putter to the hands of a golfer comprising an elongated plastic mesh, and securing means for securing said plastic mesh in position on said putter grip.

The various aspects of the present invention will be more fully understood when the following portions of the specification are read in conjunction with the accompanying drawings wherein:

BRIEF DESCRIPTION OF THE DRAWINGS

FIG. 1 is a side elevational view of a putter having the putter grip sensitizer attachment of the present invention mounted on the grip thereof;

FIG. 2 is an enlarged fragmentary side elevational view of the putter grip sensitizer attachment mounted on the putter grip;

FIG. 3 is a cross sectional view taken substantially along line 3—3 of FIG. 2;

FIG. 4 is a fragmentary cross sectional view taken substantially along line 4—4 of FIG. 2 and showing the overlapping strips of the sensitizer attachment in greater detail; and FIG. 5 is a cross sectional view similar to FIG. 3 but showing the sensitizer attachment installed on a putter grip having a cross sectional shape which differs from that shown in FIG. 3.

DESCRIPTION OF THE PREFERRED EMBODIMENTS

The putter grip sensitizer attachment 10 of the present invention is for mounting on the existing conventional grip 11 of a putter having a conventional shaft 12 and a putter head 13 at the end thereof which is opposite to the end on which grip 11 is mounted. Structurally the conventional grip can include a core 14 mounted on shaft 12 and a resilient cover 15 mounted on core 14. The foregoing described putter grip 11 is merely being shown by way of example and it will be appreciated that the putter grip attachment 10 of the present invention can be installed on any existing type of conventional putter grip regardless of its shape or the material from which it is made, as will become more apparent hereafter.

The putter grip attachment 10 is an elongated tubular plastic mesh consisting of outer plastic strips 17 which cross over inner plastic strips 19 and are fused thereto at their crossover points 20 to form diamond-shaped openings 21. As can be seen from FIG. 4, the mesh is slightly elevated at crossover points 20. The fact that the crossed over strips 17 and 19 are formed in a diamond pattern causes the tubular mesh to be expandible to thus accommodate itself both to the taper of the grip 11 and also to its cross sectional shape, whether it be round or irregular, such as shown in FIG. 5 wherein the portions of the putter grip corresponding to that shown in FIG. 3 are depicted by primed numerals which correspond to the unprimed numerals of FIG. 3.

The ends of the elongated tubular plastic mesh 16 are secured to grip 11 by plastic tapes 22 and 23 having a pressure-sensitive adhesive coating. Plastic tapes 22 and 23 are wound around the ends of the mesh 16 and onto the adjacent parts of grip 11. More specifically, plastic tape 22 has a lower portion 24 which adheres to the end 25 of tubular mesh 16 and it has a portion 27 which adheres to the adjacent portion of grip 11. Likewise tape 23 has a portion 28 which adheres to the end of tubular mesh 16 and it has a portion 29 which adheres to the adjacent portion of grip 11. Thus, mesh 16 is firmly secured to the outer surface of grip 11. In addition, the strips 17 and 19 bear against the resilient surface of layer 15 and thus also are held against slipping.

The elongated tubular plastic mesh 16 is a product of Protective Closures, Inc. of Buffalo, N.Y. and the strand sizes come in thicknesses of sixty, seventy and eighty thousandths of an inch. The preferred size is seventy thousandths of an inch.

In use, the elongated tubular plastic mesh of the proper length, such as illustrated in FIG. 1, is slipped over the putter grip 11. The mesh 16 in its unexpanded size should be less than the minimum diameter of the grip 11 over which it is to be placed so that there will be no buckling at tape 23. It will be appreciated that since the mesh 16 is expandible, it will thus accommodate itself to the taper of the grip as it approaches the outer end thereof. Furthermore, as mentioned above, if the grip is other than frustoconical, such as shown in FIG. 5, the expandability of the mesh will cause it to conform to whatever shape it is mounted on.

In use, when the golfer grips the putter, because that there is less surface area on attachment 10 than on the original putter grip 11, the strips will tend to press into the flesh on the golfer's hands and thus sensitize them against gripping the club too hard. This is especially the case since the crossover points 20 provide even greater pressure points than if the strips 17 were perfectly smooth. The fact that the golfer's grip is thus sensitized provides a sensory feedback to him which influences the force and direction of the stroke. In other words, the golfer's stroke is more controlled because of a more sensitive feel.

The elongated tubular mesh 16 is conventionally used to protect cylindrical objects such as pipe and other irregular parts from damage in transit or under other conditions. It has been used in the past to protect against physical damage of machined, polished, plated, coated or threaded cylindrical parts and parts of other shapes. In other words, insofar as known in the past it has been used only as a protective wrapping.

While preferred embodiments of the present invention have been disclosed, it will be appreciated that it is not limited thereto but may be otherwise embodied within the scope of the following claims.

What is claimed is:

1. A putter grip sensitizer attachment for installation over an existing putter grip for sensitizing the feel of a putter to the hands of a golfer comprising a first series of a plurality of inner plastic strips, a second series of a plurality of outer plastic strips, said plurality of outer plastic strips in their entireties being located outwardly of said plurality of inner plastic strips, said plurality of outer plastic strips extending transversely to said plurality of inner plastic strips and crossing said plurality of inner plastic strips at crossover points, said first series of inner plastic strips and said second series of outer plastic strips forming an elongated tubular mesh, and said outer plastic strips having slightly elevated portions with respect to adjacent portions of said outer strips at crossover points, and securing means for securing said elongated tubular mesh in position relative to a putter grip.

2. A putter grip sensitizer attachment as set forth in claim 1 wherein said outer plastic strips are fused to said inner plastic strips at said crossover points.

3. A putter grip sensitizer attachment as set forth in claim 2 wherein said first and second plastic strips are formed in an expandable diamond pattern.

4. A putter grip sensitizer attachment for installation over an existing putter grip for sensitizing the feel of a putter to the hands of a golfer comprising a first series of a plurality of inner plastic strips, a second series of a plurality of outer plastic strips, said plurality of outer plastic strips in their entireties being located outwardly of said plurality of inner plastic strips, said plurality of outer plastic strips extending transversely to said plurality of inner plastic strips and crossing said inner plastic strips at crossover points, said first series of inner plastic strips and said second series of outer plastic strips forming an elongated tubular mesh with open spaces therebetween, said open spaces being wider than the width of said inner and outer plastic strips, and slightly elevated portions of said outer plastic strips with respect to adjacent portions of said outer strips at said crossover points, and means joining said outer plastic strips to said inner plastic strips to produce said slightly elevated portions of said outer plastic strips at said crossover points.

5. A putter grip sensitizer attachment as set forth in claim 1 wherein said plastic strips are between about 0.060 and 0.080 inches in diameter.

6. A putter grip sensitizer attachment as set forth in claim 2 wherein said plastic strips are between about 0.060 and 0.080 inches in diameter.

7. A putter grip sensitizer attachment as set forth in claim 3 wherein said plastic strips are between about 0.060 and 0.080 inches in diameter.

8. A putter grip sensitizer attachment as set forth in claim 4 wherein said plastic strips are between about 0.060 and 0.080 inches in diameter.

* * * * *